United States Patent [19]

Kim

[11] Patent Number: 4,506,854

[45] Date of Patent: Mar. 26, 1985

[54] COLLAPSIBLE GOLF BAGS AND SUPPORTS THEREFOR

[76] Inventor: Hyoung J. Kim, 525 S. Lafayette Park Pl. #112, Los Angeles, Calif. 90057

[21] Appl. No.: 458,157

[22] Filed: Jan. 14, 1983

[51] Int. Cl.[3] ..... A63B 55/00

[52] U.S. Cl. ..... 248/96

[58] Field of Search ..... 248/95–97, 248/99–101

[56] References Cited

U.S. PATENT DOCUMENTS

| | | | |
|---|---|---|---|
| 1,715,668 | 6/1929 | Mooney | 248/96 |
| 1,741,057 | 12/1929 | Howe | 248/96 |
| 1,790,092 | 1/1931 | Duguid | 248/96 |
| 1,826,216 | 10/1931 | Johnson | 248/96 |
| 1,918,447 | 7/1933 | Blatz | 248/96 |
| 2,045,147 | 6/1936 | Johnson | 248/96 |
| 3,358,951 | 12/1967 | Carter | 248/669 |
| 3,610,559 | 10/1971 | Leitzel | 248/96 |
| 4,226,389 | 10/1980 | Neth | 248/96 |

FOREIGN PATENT DOCUMENTS

| | | | |
|---|---|---|---|
| 776533 | 1/1968 | Canada | 248/96 |
| 2488139 | 2/1982 | France | 248/96 |
| 671613 | 5/1952 | United Kingdom | 248/96 |

*Primary Examiner*—Reinaldo P. Machado
*Assistant Examiner*—Alvin Chin-Shie
*Attorney, Agent, or Firm*—Natan Epstein

[57] ABSTRACT

A removable support assembly for a collapsible golf bag of the type having an open top cuff, a closed bottom cuff and a pliable intermediate back portion connecting the two cuffs. The removable support assembly comprises a base slidable into the bottom cuff. The base is dimensioned and configured so as to be held within the bottom cuff against any substantial lateral displacement. The support assembly further comprises an upper brace removably attachable to the upper cuff of the golf bag, and a supporting shaft connected to the base at one end and to the upper brace at the opposite end for keeping the collapsible golf bag upright. The supporting shaft is threaded at one end to provide a means for adjusting the effective length of the supporting assembly and is spring loaded at the opposite end to keep the pliable intermediate portion of the bag in a taut wrinkle free condition. Also disclosed is an improved portable stand for golf bags which comprises a supporting frame including an upright tubular support and a set of extendable legs. The tubular support is provided with a pair of bag retaining means which serve to hold the upper and lower cuffs of a golf bag to the upright tubular support. The improvement comprises bending the upright tubular support so as to displace an intermediate length of the tubular support away from the golf bag so as to define a concavity for accommodating a pocket of a golf bag.

15 Claims, 7 Drawing Figures

Fig. 1.
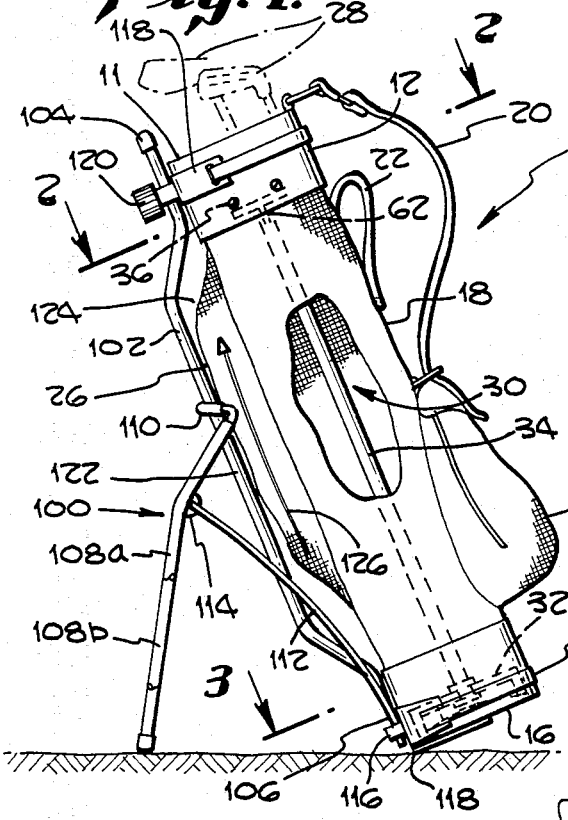
Fig. 7.
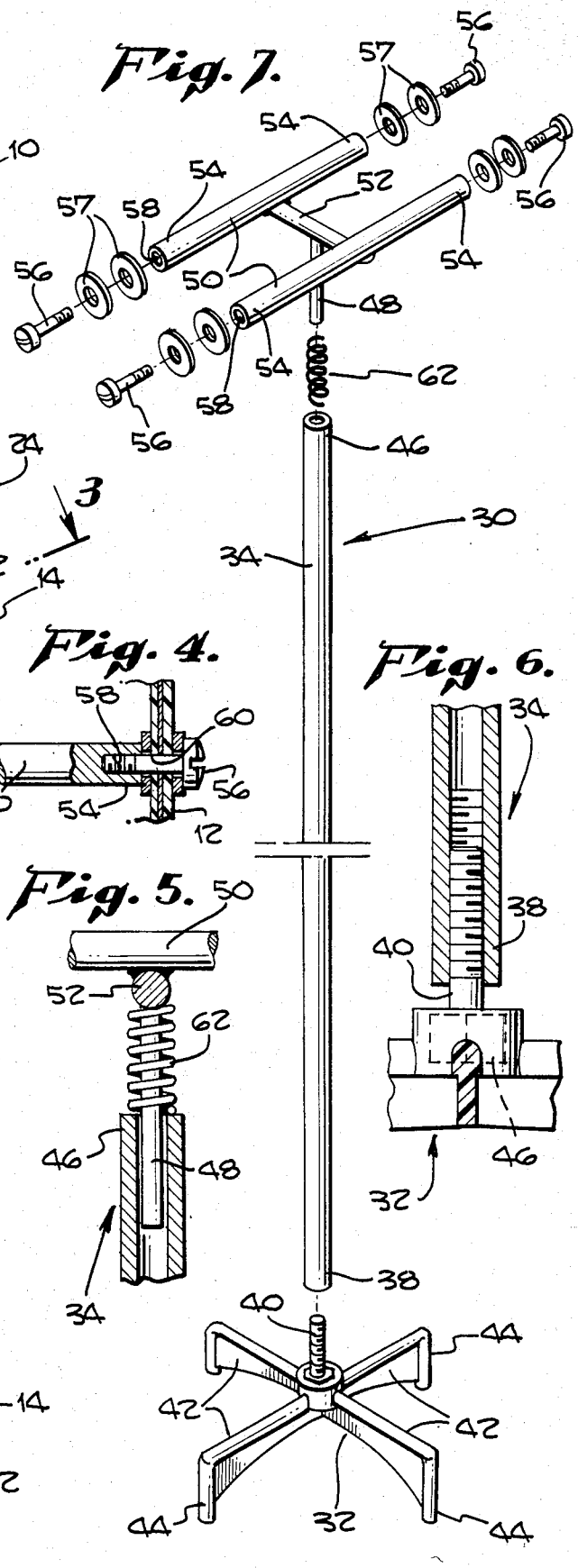
Fig. 4.
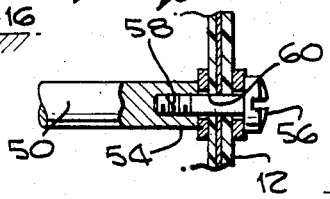
Fig. 6.
Fig. 2.
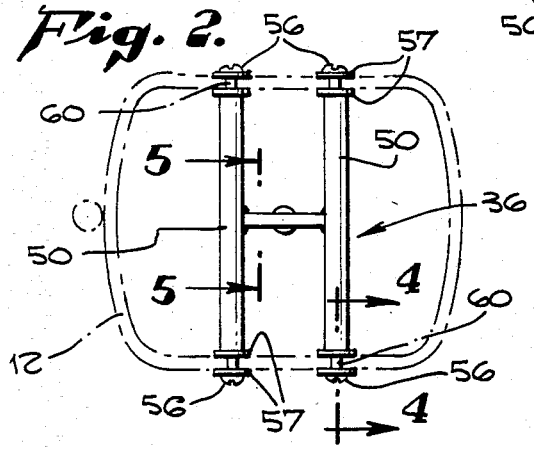
Fig. 5.
Fig. 3.
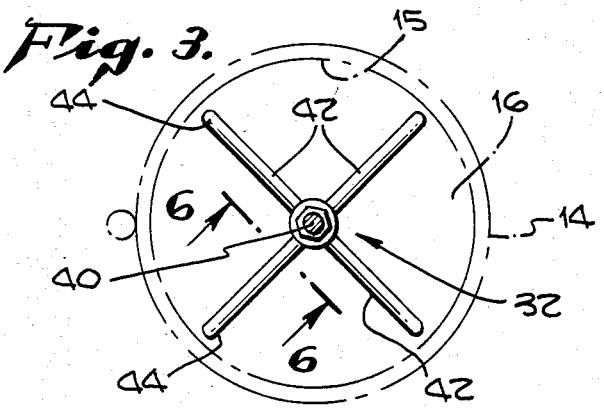

COLLAPSIBLE GOLF BAGS AND SUPPORTS THEREFOR

BACKGROUND OF THE INVENTION

1. Field of the Invention

The present invention pertains to the field of golfing bags such as are used for carrying a set of golf clubs, as well as portable stands for supporting such bags, and more particularly relates to a removable support assembly for collapsible golf bags and an improved portable stand for golf bags including collapsible golf bags.

2. State of the Prior Art

Golf bags have been in widespread use as standard equipment of the sport for many years. Golf bags typically have a tubular construction closed at the bottom and have a carrying strap of sling attached between an upper and a lower portion of the bag. The bag is opened at the top for receiving one or more golfing clubs. One type of golf bag is constructed of a substantially rigid material, for example, leather or a pliable material which is reinforced with a supporting wire structure so that the golf bag is self-supporting and can be stood up in an upright position without benefit of external support. This type of golf bag is generally a bulky item, about three feet in length and available in various diameters, such as 9 or 12 inches. An article of this size is costly to stock in inventory and to ship in commerce, due to the volume it occupies. In fact, the cost of transportation of golf bags represents a substantial fraction of the ultimate retail price of the article. In an effort to avoid this difficulty, collapsible golf bags were devised, and have become extremely popular among golfers. A typical collapsible golf bag includes an open upper cup which may be either circular or rectangular and which is made of a material which is sufficiently rigid to generally retain its shape. The bag also includes a bottom cup which is likewise either circular or rectangular to match the upper cup and is closed at one end to provide a bottom for the bag. The bottom cup is also made of a relatively rigid and durable material so that it will withstand repeated scraping and will support the weight of a set of golf clubs. The upper and lower cups are connected by a tube of pliable material such as a durable textile which is securely connected at its ends to the cuffs. This structure is not self-supporting and cannot stand upright unless supported by external means. Collapsible bags may be carried without difficulty by means of a sling or shoulder strap normally provided which is connected at its upper ends to the upper cuff and the lower end of the strap is attached to some intermediate portion of the bag. In fact, when the bag is carried, the bag depends from the upper cuff and self-support is not required.

However, when it is desired to put down the bag during play or otherwise, the bag cannot stand on its own and must be either laid down on its side or provided with external support. Various means are known and used for providing such auxiliary support for collapsible golf bags. Once such class of device is a lightweight portable bag stand provided with an upright tubular support to which are affixed a pair of bag retaining straps and retractible legs which support the upright member in a standing position, the bag retaining straps in turn holding the bag to the upright member. While this type of portable stand is useful with either collapsible or self-supporting golf bags, it is particularly useful with the collapsible type.

A somewhat different approach to the support of collapsible golf bags has been taken by other manufacturers which provide several, e.g. three relatively stiff lengths of wire which can be individually attached to the inside of a collapsible bag between upper and lower sockets provided for each wire at circumferentially spaced locations along the inside of the upper and lower cups. This approach suffers from the difficulty that each supporting wire must be separately inserted into its corresponding sockets. This can be a rather frustrating task since the sockets have small openings which are easily missed when attempting to insert the wires. The bottom sockets are difficult to see because they are in the dim interior of the golf bag and are not easily accessible from the top. Once the lower end of each wire is inserted into the bottom socket, the wire must be bent and its upper end inserted into the upper socket so that the bag is supported by the spring force of the arched spring wire. Again the opening of the upper sockets faces downward into the bag and is not easy to find while the supporting wire is being kept in a bent condition. No provision is made for adjusting the length of the wires for maintaining optimal tension between the two cuffs so as to evenly stretch the pliable intermediate portion of the bag to maintain an esthetically pleasing smooth, wrinkle free appearance.

The portable stands known to the art also suffer from a significant shortcoming in that no provision has been made in any device known to this applicant for accommodating the garment or clothing pocket normally provided on the exterior of golf bags, both of the collapsible and self-supporting types.

SUMMARY OF THE INVENTION

The present invention overcomes the shortcomings of the prior art by providing a removable support assembly for use with collapsible golf bags. The support assembly of this invention includes a base member which is dimensioned and configured so as to be slidable into the golf bag against the closed end of the bottom cuff. The base is constructed such that it is not free to move laterally to any substantial degree within the bottom cuff and desirably it contacts the bottom of the bottom cuff at three or more spaced apart points, such as for example, the four corners of a rectangular lower cuff so as to avoid any pivotal movement of the base relative to the lower cuff. A supporting member such as a straight relatively thin, but substantially rigid shaft is affixed at its lower end to the base and is supported at is upper end by the upper brace in spaced relationship with the inside of the upper cuff. The upper bracket is removably attachable to the upper cuff and is the only portion of the support assembly which is secured to the collapsible golf bag. The length of the supporting shaft is dimensioned such that the base is urged against the bottom cuff so as to keep the intermediate pliable portion of the bag taut. The collapsible bag equipped with the removable support of this invention becomes self-supporting.

The upper bracket is desirably constructed as an H shaped bar of relatively thin tubing which is mounted transversely within the upper cuff and extends across the upper opening of the bag. The upper bracket may be secured to the upper cuff by a variety of means. The presently preferred manner of attachment is to form threaded bores at the free end of the H bracket and to secure the bracket to the upper cuff by means of screw fasteners inserted through holes in the upper cuff. Four such screws are used so that the H bracket is securely fastened in a horizontal plane transverse to the long axis of the golf bag. In a preferred embodiment of the supporting assembly, the supporting shaft is threaded at one end for engagement with a mating thread formed in the base. The length of the threading in the base is made sufficiently long so as to provide a range of adjustment of the effective length of the supporting shaft by varying the degree to which the threaded end of the shaft is inserted into the mating thread of the base. The upper end of the supporting shaft is made to telescope with a portion of the upper bracket such that the supporting shaft may slide vertically through a limited distance in telescoping engagement with a portion of the upper bracket. A helical coil spring is mounted in compression between the supporting shaft and the upper bracket, such that when the support assembly is mounted in a collapsible bag and the length of the supporting shaft is properly adjusted by the afore mentioned threading into the base, the spring urges the supporting shaft and consequently the base against the closed end of the lower cuff, in effect urging apart the upper and lower cuffs of the collapsible bag. The effect is to maintain the pliable intermediate portion taut and wrinkle free for a pleasing appearance.

The support assembly is desirably supplied as a kit of parts which includes the base, the upper brace included suitable fasteners for detachably securing the upper brace to the open upper cuff of a collapsible bag, and a supporting member such as the afore mentioned shaft for mounting between the base and the upper brace so as to stably support the base and the upper brace in spaced mutually parallel relationship within a collapsible bag. By supplying the support structure as a kit of parts it is made easily portable since the base and the upper bracket together can be stored at the bottom of the collapsed bag leaving only the thin shaft. This assembly of the support structure likewise facilitates stocking of the item for sale and shipping in commerce.

The portable golf bag stands of the prior art have a bag supporting frame including a tubular support including an upper end and a lower end, and bag retaining straps or equivalent retainers attached near the upper and lower ends of the tubular support for supporting a golf bag in generally upright position along one side of the frame. In existing portable stands of this type, the tubular support is constructed as a straight length of tubing supported in a generally upward position by foldable legs and having bag retainers at its upper and lower ends. Golf bags generally have a relatively small accessory pocket near the bottom of the bag on what may be considered the front side of the bag. The rear side of the bag includes the carrying strap and normally a clothing pocket which extends along a major portion of the bags height. When such a bag is mounted to a portable stand of the type described above, the bag must be secured to the tubular support in a sideways position, that is a sideface of the bag between the accessory and the clothing pocket must be placed againts the tubular support and the bag secured to the stand by means of the straps or other retainers provided. The sideways mounting position of the bag to the stand is less desirable and also less pleasing than a mounting position where the rear side of the bag is against the tubular supporting frame so that the accessory pocket extends directly to the front of the frame of the stand and is thus more readily accessible. By placing the accessory bag further away from the legs of the stand, the legs are less likely to interfere with a player reaching into the accessory pocket.

The present invention therefore improves over the prior art by providing an arcuate supporting member for a portable golf bag stand. The arc of the tubular support of the stand is away from the side of the frame to which is held the golf bag. The arc of the supporting member therefore defines a concavity along the supporting member intermediate its upper and lower ends which accepts the bulge of the clothing pocket of a golf bag. It will be appreciated that this manner of mounting the bag to the stand does not substantially interfere with ready access to the clothing pocket. The clothing pocket is typically provided with a zippered opening which extends along one side of the pocket rather than the rear face of it which will lie against the upright supporting member of the stand. Thus, it is readily possible to reach into the clothing pocket even while the golf bag is mounted to the stand. The stands of this type are very lightweight, such that the bag is carried with the stand attached to it on the course so that the bag may be set down and supported during actual play.

These and other characteristics of the present invention are better understood by reviewing the following figures, which are submitted for the purposes of illustration only and not limitation, wherein like elements are referenced by like numerals, in light of the detailed description of the preferred embodiments.

BRIEF DESCRIPTION OF THE DRAWINGS

FIG. 1 is a side elevational view of a collapsible bag partly broken away to show a removable support mounted within the bag according to the present invention. The bag is also shown supported in a portable stand improved according to the present invention.

FIG. 2 is a view taken along line 2—2 in FIG. 1 showing the mounting of the upper bracket to the upper cuff of the golf bag.

FIG. 3 is a section taken along line 3—3 in FIG. 1 showing the base of the removable support within the lower cuff of the golf bag.

FIG. 4 is an enlarged fragmentary section taken along line 4—4 in FIG. 2, illustrating a screw fastener for securing the upper bracket of the removable support to the upper cuff of the collapsible golf bag.

FIG. 5 is a section taken along line 5—5 in FIG. 2 showing the spring loaded telescoping coupling between the upper bracket and the supporting shaft.

FIG. 6 is an elevational section along line 6—6 in FIG. 3 illustrating the adjustable threaded connection between the base of the removable support and the supporting shaft.

FIG. 7 is an exploded view of a removable support for collapsible golf bags constructed according to this invention.

DETAILED DESCRIPTION OF THE INVENTION

With reference to the drawings and FIG. 1 in particular, a collapsible golf bag 10 comprises an upper cuff 12, a lower cuff 14 closed at the bottom 16 and a relatively pliable intermediate back portion 18 of tubular construction which is securely connected at its upper and lower ends to the upper and lower cuffs respectively. A carrying sling or shoulder strap 20 is connected at its upper end to the upper cuff 12 and at its lower end is fastened to an intermediate point of the collapsible bag 10. The bag is further provided with a carrying handle 22 which may be used instead of the sling 20 if more convenient. The collapsible golf bag typically also includes a frontal accessory pocket 24 attached to the exterior of the bag at a lower point thereof, and a garment or clothing pocket 26 also attached exteriorly to the collapsible bag opposite the accessory pocket 24, that is at the rear of the bag 10. The garment pocket extends substantially along the entire intermediate portion 18 of the collapsible bag, and is used for carrying articles of clothing such as an extra sweater or a jacket. The accessory pocket 24 is typically used for carrying golf balls, tees, etc. Golf clubs 28 are carried in the bag in the manner illustrated in FIG. 1 with the handles inverted into the bag.

The removable support 30 of this invention is shown in FIG. 1 partly in dotted lines and partly in solid lines through the broken away middle portion of the collapsible golf bag. The removable support comprises base 32 shown in dotted lines within the bottom cuff 14 of the golf bag and abutting the bottom 16 of the bottom cuff. A supporting shaft 34 is connected at its lower end to the base 32 and is attached at its upper end to an upper brace 36 shown in dotted lines in FIG. 1. The upper brace is removably fastened to the upper cuff 12 so that the supporting shaft 30 is maintained substantially centered within the tubular interior of the collapsible golf bag. The supporting shaft 34 may be a length of metalic tubing of relatively small diameter so as to occupy a minimal portion of the volume within the bag.

The construction of the various elements of the removable support 30 is better understood by reference to the exploded view of FIG. 7.

The supporting shaft 34 is interiorly threaded at its lower end 38 as best seen in the cross section of FIG. 6. The base 32 is provided with a threaded upwardly extending bolt 40 which threads into the lower end 38 of the supporting shaft. The base 32 may take various forms, but preferably has the configuration illustrated in the drawings where the base is seen to consists of four legs in a cross configuration as seen in the plan view of FIG. 3. Each of the legs 42 may be curved on their underside, such that the base 32 rests against the bottom 16 of the lower cuff only at four outer points 44. This configuration of the base 32 is particularly well suited for a golf bag of generally rectangular cross sections, such as is illustrated in FIGS. 1 and 2. For other cross sections of the bag such as circular, the same base configuration illustrated may be employed or other base configurations may be substituted provided that sufficient contact is made with the bottom 16 of lower cuff to provide stable abutment between the base and the bottom and prevents any substantial wabble of the lower cuff when the base 32 is urged against the bottom 16. The base 32 may be molded of a thermoplastic material provided with a central opening through which is inserted the threaded bolt 40. The head 46 of the bolt, may be hexagonal and fits within a mating socket formed in the base 32 so that the bolt 40 is not free to rotate relative to the base.

The cross configuration of the base 32 provides the additional advantage that when the supporting assembly of the invention is mounted within a collapsible golf bag and golf clubs are inserted into the bag as shown in FIG. 1, the legs 42 act as dividers to hold the clubs against excessive shifting while the clubs are carried in the bag. The thickness of the legs 42 is kept small as shown in the plan view of FIG. 3 so that the base does not occupy a significant area of the bag cross section and thus does not interfere with placement of the golf clubs into the bag.

The upper end 46 of the supporting shaft 34 is connected for telescoping engagement with a rod 48 which extends downwardly from the upper bracket 36. The rod 48 may be a length of rod or tubing having a diameter such as to fit snugly into the hollow interior of the supporting shaft 34 for smooth sliding movement into and out of the supporting shaft. The upper bracket 36 is preferably of H-shaped configuration as shown in the plan view of FIG. 2 and also in FIG. 7. The bracket 36 thus consists of two parallel members 50 joined at their midpoint by a cross member 52 which may be welded to the parallel members 50. The various portions or members of the upper bracket 36 may consists of lengths of metal tubing or metal rod welded together so as to mate a strong rigid bracket structure. The H-shaped bracket 36 has four free ends 54 which are fastened to the inside of the upper cuff 12 of the collapsible golf bag such that the plain defined by the parallel members 50 and cross member 52 of the bracket lies substantially perpendicular to the long axis of the golf bag 10. A presently preferred method of removably securing the upper bracket 36 to the upper cuff 12 of a golf bag is illustrated and consists of threaded fasteners such as screws 56 which thread into correspondingly threaded bores 58 defined in the free ends 54 of the upper bracket 36. The mounting of the upper bracket 36 to the upper cuff 12 of the golf bag. The threaded fasteners 56 are inserted through holes 60 defined in the upper cuff 12. The newly constructed golf bags, such holes may be provided by the manufacture. With existing golf bags already owned by players, such holes may be made by the owner of the golf bag. In the alternative, many golf bags made by various manufacturers include a strap not shown in the drawings which encircles the upper cuff 12 and is threaded through grommeted openings in the upper cuff. It is possible to remove the strap and utilize these grommeted openings for inserting the threaded fasteners 56 so as to secure the upper bracket 36 to the upper cuff 12.

A helical coil spring 62 fits coaxially on the connecting rod 48 of the upper bracket 36. The diameter of the spring 62 is such that it abuts against the upper end of the supporting shaft 34 when the connecting rod 48 is telescoped into the supporting shaft, as best seen in FIG. 5. The spring 62 is thus compressed between the upper bracket 36 and the supporting shaft 34 when the supporting assembly 30 is mounted within a golf bag as shown in FIG. 1.

The removable support 30 may be supplied as a kit of parts consisting of the base 32, the supporting shaft 34, the upper bracket 36 with the spring 62 which may be permanently affixed at its upper end or otherwise secured to the connecting rod 48, and a set of suitable fasteners 56 and washers 57.

In preparation for use, the supporting rod 34 is threaded onto the bolt 40 of the base 32. The length of the bolt 40 is such as to provide a range of adjustment for the effective length of the support assembly. As seen in FIG. 6, the lower end 38 of the supporting shaft may be threaded to a greater or lesser degree onto the bolt 40 so as to extend or shorten the overall length of the assembly. The base 32 is then easily slipped into the collapsible bag 10 until the legs 42 rests against and abut the bottom 16 of the lower cuff 14. The legs 42 are dimensioned such that the base 32 fits easily within the lower cuff 14. A small clearance may be allowed between the ends 44 of the legs and the inner surface 15 of the lower cuff for ease of insertion. The dimensions of the base 32 should, however, be such that the base is not free to shift laterally to a considerable degree within the lower cuff 14.

The upper bracket 36 is then telescopically coupled to the upper end 46 of the supporting shaft 34 by inserting the connected rod 48 into the hollow upper end of the supporting shaft. The upper bracket is pressed downwardly to compress the helical spring 62 until the free ends 54 of the upper bracket are aligned with the openings 60 in the upper cuff 12 with the golf bag while the golf bag is manually or otherwise supported in fully erect position. The thread of fasteners 56 are then inserted through the hole 60 in the upper cuff and threaded into the corresponding bores 58 in the upper bracket 36. The upper cuff 12 is thus secured to the upper bracket which in turn keeps the spring 62 compressed against the upper end of the supporting shaft 34. If the degree of compression of the spring 62 is either too great or too slight when the upper bracket 36 is brought into alignment with the holes 60 in the upper cuff, the effective length of the supporting assembly may be adjusted by increasing or decreasing the extent of threaded engagement between the lower end 38 of the supporting shaft 34 and the base bolt 40. Desirably the degree of compression of the spring 62 should be such that extreme effort is not required to obtain alignment between the bracket 36 and the apertures 60 in the cuff 12, as this would place an unnecessary degree of strain on the supporting assembly as well as on the collapsible golf bag 10. Conversely too little compression on the spring 62 may be insufficient to keep the inpliable intermediate portion 18 of the bag in a taut wrinkle free condition. An optimum combined length of the base 32 and supporting shaft 34 is readily obtained at the time of assembly simply by holding down the bracket 36 and rotating the shaft 34 relative to the base 32 until the bracket 36 is brought into alingment with the hole 60 in the upper cuff 12. As can be appreciated, installation of the support assembly 30 does not require any kind of fastening or adjustment at the bottom end of the golf bag. All fastening and adjustment is carried out at the upper end of the supporting assembly and the collapsible bag and may be readily done in a comfortable standing position by the person doing the installation. The threaded fasteners may be easily inserted into the end of the bracket 36 which are in plain sight and well lit near the open upper end 11 of the upper cuff 12.

Alternate methods of fastening the upper bracket 36 to the upper cuff 12 may be employed. For example, a pair of plates may be fastened as by rivoting to the interior of the upper cuff 12. The plates may be perforated for receiving the ends 54 of the upper bracket 36 so as to resist the expansion force of the spring 62. Yet other methods of fastening the upper bracket 36 to the upper cuff 12 will become apparent.

Illustrated in FIG. 1 is a portable stand 100 which includes a tubular support member 102 which has an upper end 104 and a lower end 106. The support member 102 is attached to a supporting frame which includes a pair of extendable legs **108*a* and 108*b* hinged at 110. A mechanism known in the art for automatically extending the legs 108*a* and 108*b* when the stand is set down on the ground includes a forked actuator 112 having two arms connected at their upper ends in hinged fashion to the legs 108*a* and 108*b* at 114. The actuator member 112 extends below the lower end 106 of the supporting member 102 such that when the stand 100 is set on the ground the weight of the bag causes the actuator member to slide upwardly within a guide 116 causing the legs 108*a* and 108*b* to pivot away from the supporting member 102. This mechanism is known in the art and need not be described in greater detail. The tubular supporting member 102 is provided with upper and lower bag retaining devices 118 which typically includes straps for encircling the upper and lower cups 12 and 14 respectively of a bag so as to hold a bag in upright position against the support 102. This type of stand is particularly useful with collapsible bags since it keeps the upper and lower cuffs in spaced apart relationship. The upper bag retaining strap may be slidable mounted to the upper portion of the tubular support 102 and provided with a set knob 120 to fasten the retainer 118 at a desired point along the supporting tube 102**.

The golf bag 10 is mounted to the stand 100 by means of the retainers 118 and 120 such that the bag is always located on one side of the supporting framework and the tubular support 102.

According to the present invention, the tubular support 102 is bent in the manner shown in FIG. 1 so as to displace the intermediate portion 122 of the tubular support 102 away from the side to which the golf bag is attached. The displaced intermediate section 122 thus defines a concavity 124 dimensioned to accept the clothing or garment pocket 26 of the golf bag. While the dimensions of the garment pockets of different golf bag may vary, even if the dimensions of the pocket somewhat exceed the size of the concavity 124 defined by the arcuate upright member 102, this does not detract from the usefulness of the improved stand, since the pocket 26 is soft and pliable and the contents thereof are typically garments which are likewise soft, pliable and compressible. Thus, even if the displaced intermediate section 122 compresses somewhat the garment pocket 26, the bag may still be mounted to the stand 100. Further since the usual access into the garment pocket is through a zippered slit defined along one side of the garment pocket 26 access into the garment pocket is by no means hindered while the bag is mounted to the stand. The zippered opening 126 is illustrated in FIG. 1.

It must be understood that many alterations and modifications may be made by those having ordinary skill in the art to the structures disclosed herein without departing from the spirit and scope of the invention. Therefore, the presently illustrated embodiments have been shown only by way of example and for the purposes of clarity and should not be taken to limit the scope of the following claims.

What is claimed is:

1. A support assembly for a collapsible golf bag having an open top cuff, a closed bottom cuff and a pliable bag tube connecting said cuffs, said support assembly comprising a base slidable into said bottom cuff, said base being dimensioned and configured so as to be substantially restrained against lateral displacement within said bottom cuff without attachment to said bottom cuff, upper brace means extending across the inside of said upper cuff, and a relatively thin rigid support shaft extending between said base and said upper brace means and substantially centered within said bag tube, said support shaft urging said base against said bottom cuff to thereby support said top and bottom cuffs in spaced apart relationship.

2. The support of claim 1 further comprising means for adjusting the effective length of said support shaft.

3. The support of claim 1 wherein said upper brace is constructed of one or more relatively thin members so as not to substantially interfere with insertion of golf clubs into the bag.

4. The support of claim 1 further comprising fastener means secured to said upper cuff for detachably engaging said upper brace.

5. The support of claim 1 wherein said support means comprise spring means compressible between said base and said upper brace for urging apart said upper and lower cuffs to stretch and support the pliable bag tube in a substantially wrinkle free condition.

6. The support of claim 5 further comprising means for adjusting the effective length of said support shaft.

7. The support of claim 5 wherein said spring means comprise a helical spring compressible between said support shaft and one of said upper brace and said base brace.

8. The support of claim 1 wherein said upper brace is H-shaped.

9. The support of claim 8 wherein each of the four ends of said H-shaped upper brace is threaded for receiving a screw inserted through said upper cuff.

10. A kit of parts for a support assembly for use with a collapsible golf bag having an open upper cuff and a closed bottom cuff, said kit comprising a base, an upper brace including fastener means for detachably securing said upper brace to the open upper cuff of a collapsible golf bag, said base having a center, and a supporting shaft member for connecting said base to said upper brace, said base having cuff engaging portions extending generally radially from said center and adapted to hold said base against substantial lateral displacement within the bottom cuff of a golf bag without attaching the base of the cuff such that said base may be readily removed from the bottom cuff upon detachment of said upper cuff.

11. The kit of claim 10 wherein said cuff engaging portions comprise at least three legs extending radially from said base center.

12. The kit of claim 10 wherein said cuff engaging portions comprise a plurality of radially extending legs.

13. The kit of claim 10 further comprising means for adjusting the effective length of said supporting shaft member when mounted between said base and said upper base.

14. The kit of claim 13 wherein said means for adjusting further comprise compressible spring means.

15. The kit of claim 14 wherein said fastener means comprise one or more screw fasteners threadable into said upper brace.

* * * * *